US006918565B2

(12) United States Patent
Chang

(10) Patent No.: US 6,918,565 B2
(45) Date of Patent: Jul. 19, 2005

(54) ADJUSTABLE BOOK HOLDER ASSEMBLY

(76) Inventor: Chun Yuan Chang, P.O. Box 63-99, Taichung (TW) 406

( * ) Notice: Subject to any disclaimer, the term of this patent is extended or adjusted under 35 U.S.C. 154(b) by 0 days.

(21) Appl. No.: 10/693,517

(22) Filed: Oct. 22, 2003

(65) Prior Publication Data

US 2005/0087667 A1 Apr. 28, 2005

(51) Int. Cl.[7] ..... A47B 97/04

(52) U.S. Cl. ..... 248/448; 248/454; 248/458; 248/393; 211/169

(58) Field of Search ..... 248/440.1, 447, 248/458, 460, 448, 450, 454, 455, 456, 393, 248/397; 40/169, 169.1, 175, 165, 168, 167, 40/47, 48, 400, 401, 402, 403; 211/169, 169.1, 211/175, 165, 168, 167, 47, 48

(56) References Cited

U.S. PATENT DOCUMENTS

| | | | | | |
|---|---|---|---|---|---|
| 1,037,233 | A | * | 9/1912 | Furrow | 248/448 |
| 1,278,345 | A | * | 9/1918 | Hiatt | 248/447 |
| 1,634,456 | A | * | 7/1927 | Deuschle | 248/448 |
| 1,682,060 | A | | 8/1928 | Banks | |
| 1,825,716 | A | * | 10/1931 | Courtenay | 248/448 |
| 1,990,103 | A | * | 2/1935 | Van Alstyne | 248/447 |
| 2,527,277 | A | | 10/1950 | Schade | |
| 2,545,844 | A | | 3/1951 | Cougias | |
| 2,743,550 | A | * | 5/1956 | Felice | 248/457 |
| 3,408,032 | A | * | 10/1968 | Francis | 248/450 |
| 3,760,744 | A | * | 9/1973 | Cruckshank | 108/64 |
| 4,066,168 | A | | 1/1978 | O'Toole et al. | |
| 4,426,007 | A | * | 1/1984 | Beleckis et al. | 211/40 |
| 4,715,502 | A | * | 12/1987 | Salmon | 211/26 |
| 4,917,343 | A | * | 4/1990 | Wainscott | 248/447.2 |
| 5,624,096 | A | * | 4/1997 | Haynes | 248/451 |
| 6,394,291 | B2 | * | 5/2002 | Maier-Hunke | 211/169 |
| 6,457,591 | B1 | * | 10/2002 | Lee | 211/41.2 |
| 6,491,171 | B2 | * | 12/2002 | Maier-Hunke | 211/47 |
| 6,678,978 | B2 | * | 1/2004 | Maier-Hunke | 40/376 |
| 6,776,385 | B1 | * | 8/2004 | Chang | 248/448 |

* cited by examiner

*Primary Examiner*—Anita King
*Assistant Examiner*—Naschica S. Morrison
(74) *Attorney, Agent, or Firm*—Alan D. Kamrath; Nikolai & Mersereau, P.A.

(57) ABSTRACT

An adjustable book holder includes two primary frames, and one or more auxiliary frames selectively secured between the frames, to increase holding of more books or sheet members to the book holder. The primary frames and the auxiliary frames may be secured together with peg-and-aperture engagements. Two followers may be attached to the frames, and may be coupled between the primary frames and the auxiliary frames, and may be rotatably or adjustably secured to two seats, with gear engagements, to allow the followers and the primary and the auxiliary frames to be secured to the seats at selected angular positions.

12 Claims, 4 Drawing Sheets

ADJUSTABLE BOOK HOLDER ASSEMBLY

BACKGROUND OF THE INVENTION

1. Field of the Invention

The present invention relates to an adjustable book holder, and more particularly to an adjustable book holder having one or more auxiliary frames to be selectively and optionally coupled thereto for increasingly holding more books or the like.

2. Description of the Prior Art

Various kinds of typical adjustable book holders have been developed to hold various amount of books therein, and normally comprise two shelf members slidably and adjustably secured together, to support different amount of books.

For example, U.S. Pat. No. 1,682,060 to Banks discloses one of the typical adjustable book holders comprising two shelf members slidably and adjustably secured together. However, the shelf members may not be solidly secured together.

U.S. Pat. No. 2,545,844 to Cougias discloses another typical adjustable book holder also comprising two shelf members slidably and adjustably secured together, and biased or forced toward each other with spring members. Similarly, the shelf members also may not be solidly secured together.

U.S. Pat. No. 2,527,277 to Schade discloses a further typical adjustable book holder comprising one or more plates slidably engaged onto or along two tracks or a tray, to allow different amount of books to be attached onto and supported on the tracks of the tray. Similarly, the plates also may not be solidly secured together.

U.S. Pat. No. 3,760,744 to Cruckshank discloses a still further typical adjustable book holder also comprising two shelf members slidably and adjustably secured together, and legs secured to the shelf members respectively. The legs may be engaged with the shelf members to limit the movement of the shelf members relative to the legs. However, similarly, the shelf members also may not be solidly secured together.

U.S. Pat. No. 4,066,168 to O'Toole et al. discloses a still further typical adjustable book holder comprising two connecting sections each having two arms optionally and adjustably secured to holes of a plate, to adjustably secure and retain and support different amount of books on the plate. However, the connecting sections include a weak structure that may not be used to stably support the books on the plate.

The present invention has arisen to mitigate and/or obviate the afore-described disadvantages of the conventional adjustable book holders.

SUMMARY OF THE INVENTION

The primary objective of the present invention is to provide an adjustable book holder including two primary frames to be assembled and solidly secured together to solidly hold books therein.

The other objective of the present invention is to provide an adjustable book holder including one or more auxiliary frames to be selectively and optionally coupled thereto for increasingly holding more books or the like.

In accordance with one aspect of the invention, there is provided an adjustable book holder comprising a first frame, a second frame, and one or more auxiliary frames selectively secured between the first and the second frames, to increase holding of more books or the like to the book holder.

The first frame includes at least one aperture formed therein, the auxiliary frame includes at least one peg extended therefrom to selectively engage into the aperture of the first frame, to secure the first frame and the auxiliary frame together. The auxiliary frame includes at least one aperture formed therein, the second frame includes at least one peg extended therefrom to selectively engage into the aperture of the auxiliary frame, to secure the second frame and the auxiliary frame together.

Each of the first frame and the second frame and the auxiliary frames includes an upper beam and a lower beam each having a plurality of orifices formed therein, for rotatably receiving axles of sheet members.

A first and a second followers may further be provided and attached to the first and the second frames respectively. Each of the first and the second frames includes a cavity formed therein, each of the first and the second followers includes a catch extended therefrom and engaged into the cavities of the first and the second frames, to secure the first and the second followers to the first and the second frames respectively.

The first follower includes at least one aperture formed therein, the auxiliary frame includes at least one peg extended therefrom to selectively engage into the aperture of the first follower, to secure the first follower and the auxiliary frame together. The auxiliary frame includes at least one aperture formed therein, the second follower includes at least one peg extended therefrom to selectively engage into the aperture of the auxiliary frame, to secure the second follower and the auxiliary frame together.

A first and a second seats may further be provided and secured to the first and the second followers respectively. An adjustably securing device may further be provided to secure the first and the second followers to the first and the second seats respectively at selected angular positions.

The adjustably securing device includes a first gear attached to the first seat, and a second gear attached to the first follower and engageable with the first gear, to secure the first follower and the first seat together at selected angular positions. The adjustably securing device further includes a gear attached to the second seat, and another gear attached to the second follower and engageable with the gear of the second seat, to secure the second follower and the second seat together at selected angular positions.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
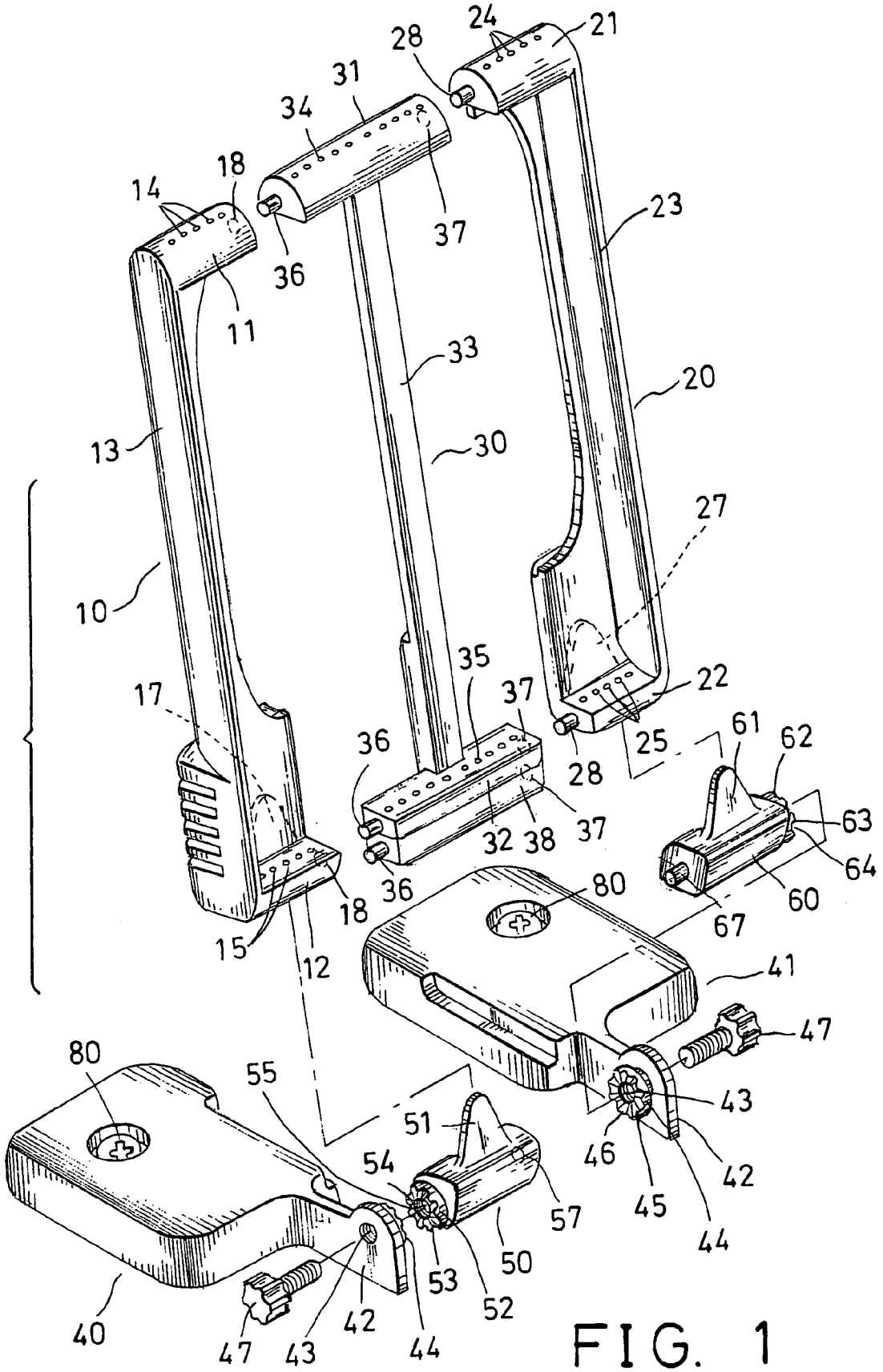
FIG. 1 is a partial exploded view of an adjustable book holder in accordance with the present invention.
Figure 2:
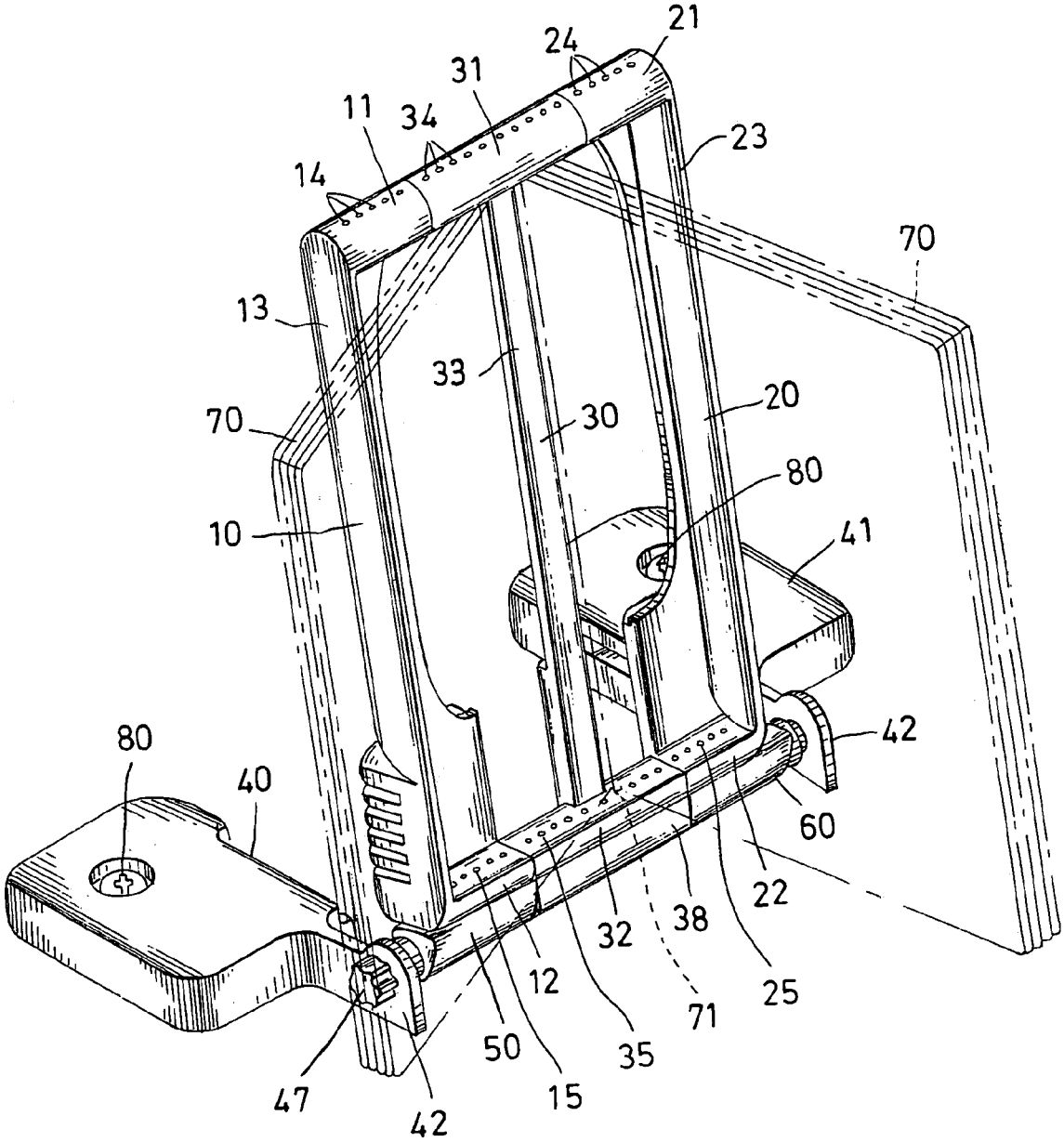
FIG. 2 is a perspective view of the adjustable book holder.

Referring to the drawings, and initially to FIGS. 1 and 2, an adjustable book holder in accordance with the present invention comprises two primary frames 10, 20 to be assembled and solidly secured together to solidly hold books therein. For example, each of the primary frames 10, 20 includes an upper portion or beam 11, 21, a lower portion or beam 12, 22, and a column 13, 23 coupled or formed or provided between the upper and the lower beams 11, 12, 21, 22.

Each of the upper and the lower beams 11, 12, 21, 22 includes a number of orifices 14, 15 formed therein, for rotatably receiving axles 71 of books or envelope or sheet members 70 (FIG. 2). Each of the lower beams 12, 22 includes a cavity 17, 27 formed therein (FIG. 1), such as formed in the bottom thereof, and opened downwardly relative to the primary frames 10, 20 respectively.

Each of the beams 11, 12 of the primary frame 10 includes an aperture 18 formed therein, and each of the beams 21, 22 of the other primary frame 20 includes a peg 28 extended therefrom for engaging into the apertures 18 of the beams 11, 12 of the primary frame 10, and for securing the primary frames 10, 20 together (FIG. 3) by such as force-fitted engagements.

Figure 4:
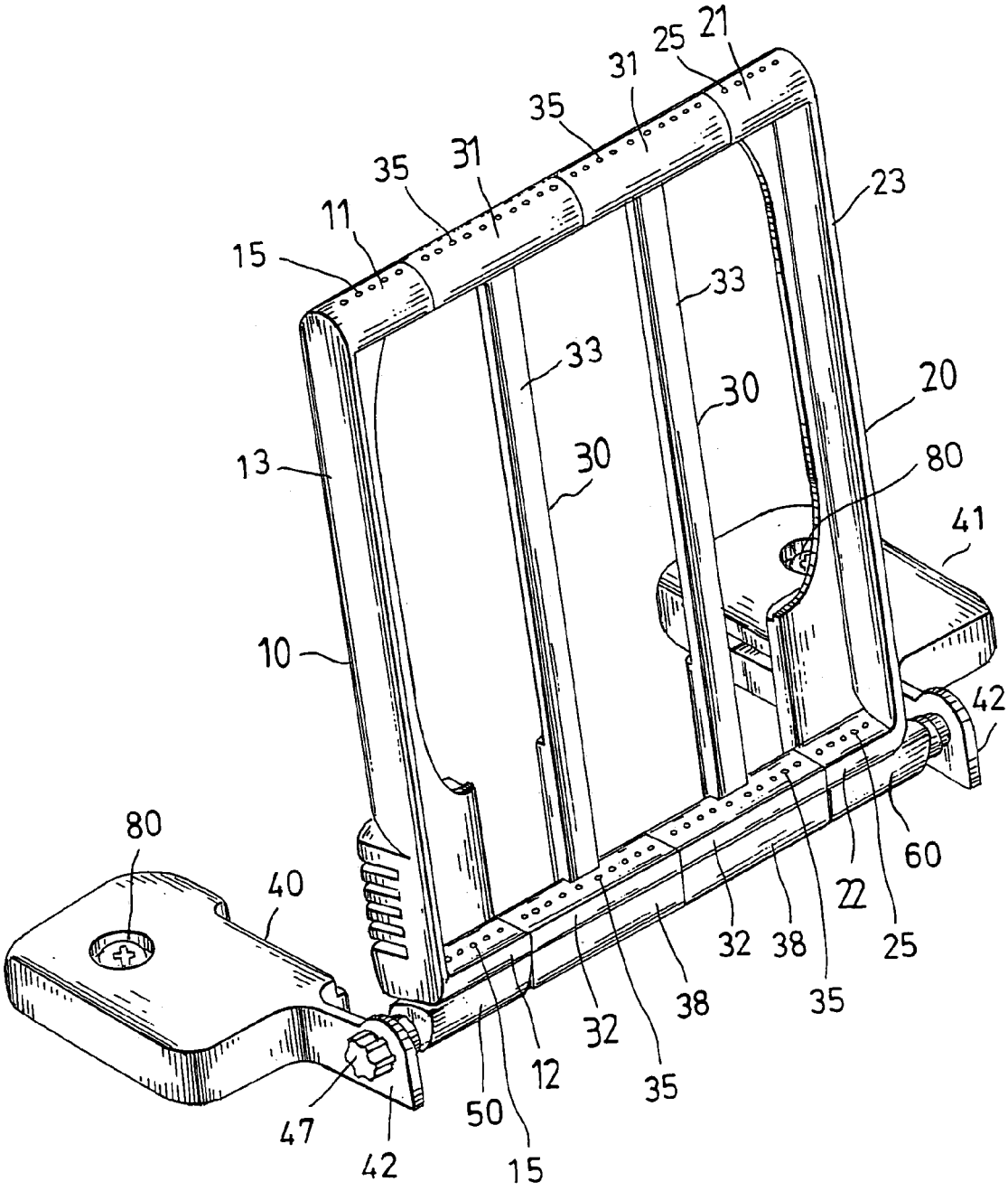

One or more auxiliary frames 30 may further be provided and selectively and optionally coupled between the primary frames 10, 20 (FIGS. 1, 2, 4), for increasingly holding more books or sheet members 70 or the like. Each of the auxiliary frames 30 may also include an upper portion or beam 31, a lower portion or beam 32, and a column 33 coupled or formed or provided between the upper and the lower beams 31, 32.

Each of the upper and the lower beams 31, 32 also includes a number of orifices 34, 35 formed therein, for rotatably receiving the axles 71 of books or envelope or sheet members 70 (FIG. 2). Each of the beams 31, 32 of the auxiliary frames 30 includes a peg 36 extended from one side thereof for selectively engaging into the apertures 18 of the beams 11, 12 of the primary frame 10, and thus for selectively securing the primary frame 10 and the auxiliary frame 30 together (FIGS. 2, 4) by such as force-fitted engagements.

Each of the beams 31, 32 of the auxiliary frames 30 further includes an aperture 37 formed in the other side thereof, to selectively receive the pegs 28 of the other primary frame 20, or to selectively receive the pegs 36 of the respective auxiliary frames 30, and thus for selectively securing the primary frame 20 and the auxiliary frame 30 together (FIGS. 2, 4) by such as force-fitted engagements, and thus for allowing one or more auxiliary frames 30 to be selectively and optionally coupled between the primary frames 10, 20.

Each of the lower beams 32 of the auxiliary frames 30 may further include an additional peg 36 extended from the one side thereof (FIG. 1), such as extended from the lower protrusion 38 of the respective lower beams 32 of the auxiliary frames 30, and may further include an additional aperture 37 formed in the other side thereof, such as formed in the lower protrusion 38 of the respective lower beams 32 of the auxiliary frames 30.

Two seats 40, 41 may be secured onto desks or walls or other support members (not shown) with fastener members 80, such as screws 80 or magnets or the like, and each includes an extension 42 having a hole 43 formed therein for receiving a fastener 47 therein, and each includes a gear 44 attached to the respective extension 42 and having a number of teeth 45 formed or defined between depressions 46 thereof.

Two followers 50, 60 each includes a catch 51, 61 extended therefrom and engaged into the cavities 17, 27 of the lower beams 12, 22 of the primary frames 10, 20, for selectively securing the followers 50, 60 to the primary frames 10, 20 respectively by such as force-fitted engagements. Each of the followers 50, 60 includes a gear 52, 62 attached thereto, and having a number of teeth 53, 63 formed or defined between depressions 54, 64 thereof.

Each of the followers 50, 60 further includes a screw hole 55 formed therein, or formed in the respective gears 52, 62, for threading with the fasteners 47, and thus for securing the followers 50, 60 to the respective extensions 42 of the seats 40, 41. The gears 52, 62 of the followers 50, 60 may be engaged with the respective gears 44 of the extensions 42 of the seats 40, 41, to allow the followers 50, 60 and thus the primary frames 10, 20 to be rotated or adjusted relative to the seats 40, 41 to different angular positions.

The follower 50 includes an aperture 57 formed in the other side thereof, opposite to the gear 52, to selectively receive the pegs 36 of the respective auxiliary frames 30, and the other follower 60 may include a peg 67 extended from one side thereof, opposite to the gear 62, to selectively engage into the apertures 37 of the lower beams 32 of the auxiliary frames 30, and thus for solidly securing one or more auxiliary frames 30 between the primary frames 10, 20 with the followers 50, 60.

Figure 3:
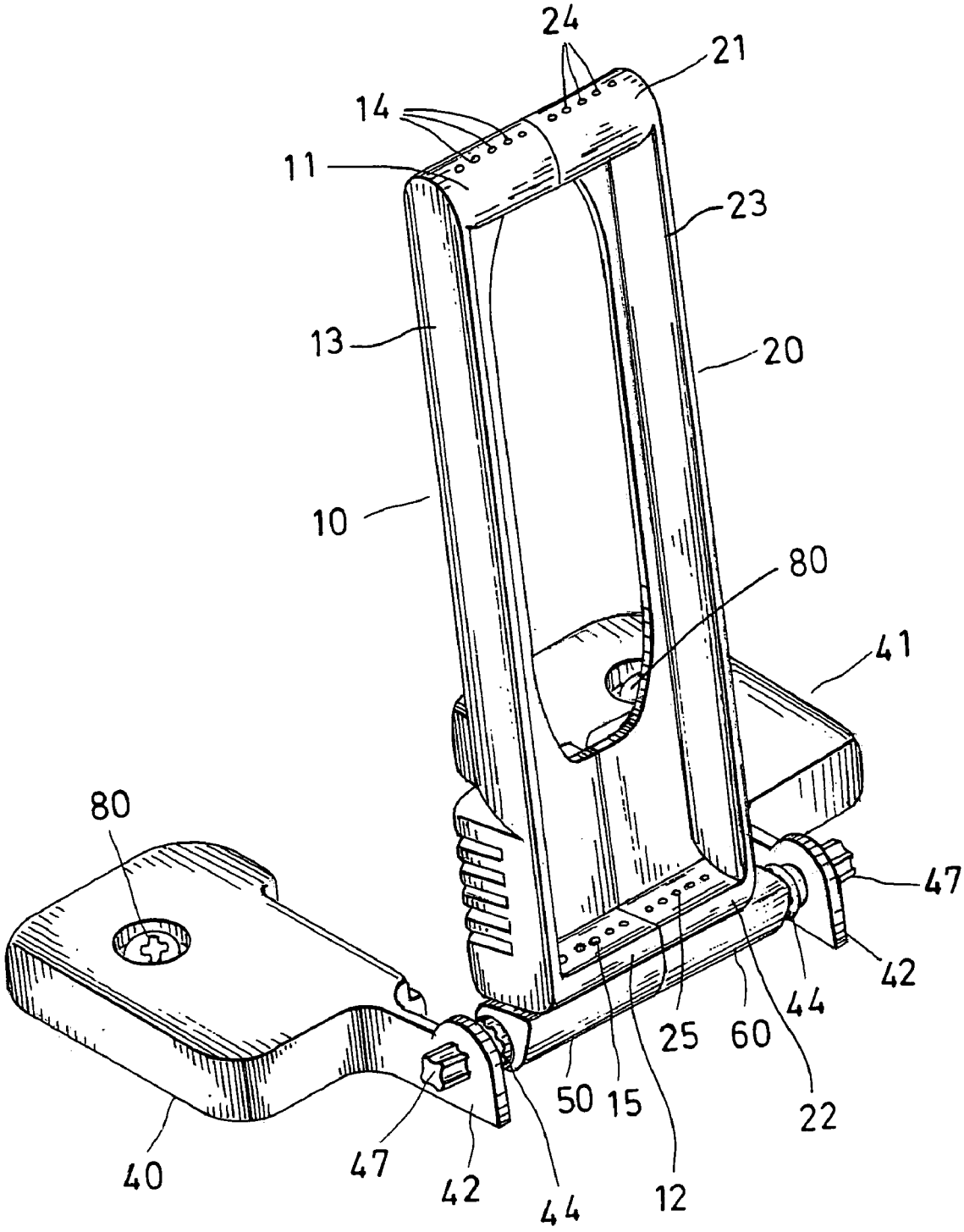
FIGS. 3, 4 are perspective views illustrating the other arrangements of the adjustable book holder having none or having two or more additional auxiliary frames selectively and optionally coupled to the primary frames.

In operation, as shown in FIG. 3, the primary frames 10, 20 may be selectively secured together by the engagements of the pegs 28 of the primary frame 20 into the apertures 18 of the beams 11, 12 of the primary frame 10, such that the primary frames 10, 20 may be selectively or optionally and solidly secured together. The primary frames 10, 20 may further be selectively and solidly secured together with the followers 50, 60 and/or the seats 40, 41.

Accordingly, the adjustable book holder in accordance with the present invention includes one or more auxiliary frames to be selectively and optionally coupled thereto for increasingly holding more books or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable book holder comprising:

a first frame, a second frame, at least one auxiliary frame selectively secured between said first and said second frames, and a first follower and a second follower attached to said first and said second frames respectively, each of said first and said second frames including a cavity formed therein, each of said first and said second followers including a catch extended therefrom and engaged into said cavities of said first and said second frames, to secure said first and said second followers to said first and said second frames respectively.

2. The adjustable book holder as claimed in claim 1, wherein said first frame includes at least one aperture formed therein, said at least one auxiliary frame includes at least one peg extended therefrom to selectively engage into said at least one aperture of said first frame, to secure said first frame and said at least one auxiliary frame together.

3. The adjustable book holder as claimed in claim 1, wherein said at least one auxiliary frame includes at least one aperture formed therein, said second frame includes at least one peg extended therefrom to selectively engage into said at least one aperture of said at least one auxiliary frame, to secure said second frame and said at least one auxiliary frame together.

4. The adjustable book holder as claimed in claim 1, wherein said first frame includes an upper beam and a lower beam each having a plurality of orifices formed therein, for rotatably receiving axles of sheet members.

5. The adjustable book holder as claimed in claim 1, wherein said second frame includes an upper beam and a lower beam each having a plurality of orifices formed therein, for rotatably receiving axles of sheet members.

6. The adjustable book holder as claimed in claim 1, wherein said at least one auxiliary frame includes an upper beam and a lower beam each having a plurality of orifices formed therein, for rotatably receiving axles of sheet members.

7. The adjustable book holder as claimed in claim 1, wherein said first follower includes at least one aperture formed therein, said at least one auxiliary frame includes at least one peg extended therefrom to selectively engage into said at least one aperture of said first follower, to secure said first follower and said at least one auxiliary frame together.

8. The adjustable book holder as claimed in claim 1, wherein said at least one auxiliary frame includes at least one aperture formed therein, said second follower includes at least one peg extended therefrom to selectively engage into said at least one aperture of said at least one auxiliary frame, to secure said second follower and said at least one auxiliary frame together.

9. An adjustable book holder comprising:

a first frame, a second frame, at least one auxiliary frame selectively secured between said first and said second frames, a first follower and a second follower attached to said first and said second frames respectively, and a first seat and a second seat secured to said first and said second followers respectively.

10. The adjustable book holder as claimed in claim 9 further comprising means for adjustably securing said first and said second followers to said first and said second seats respectively at selected angular positions.

11. The adjustable book holder as claimed in claim 10, wherein said adjustably securing means includes a first gear attached to said first seat, and a second gear attached to said first follower and engageable with said first gear, to secure said first follower and said first seat together at selected angular positions.

12. The adjustable book holder as claimed in claim 10, wherein said adjustably securing means includes a first gear attached to said second seat, and a second gear attached to said second follower and engageable with said first gear, to secure said second follower and said second seat together at selected angular positions.

* * * * *